US006687921B1

(12) United States Patent
Li

(10) Patent No.: US 6,687,921 B1
(45) Date of Patent: Feb. 10, 2004

(54) TOILET SEAT DAMPER

(76) Inventor: Feiyu Li, First Floor, #43, Huli Main Road, Xiamen (CN), 361006

( * ) Notice: Subject to any disclaimer, the term of this patent is extended or adjusted under 35 U.S.C. 154(b) by 0 days.

(21) Appl. No.: 10/340,353

(22) Filed: Jan. 10, 2003

(51) Int. Cl.[7] ..... A47K 13/12
(52) U.S. Cl. ..... 4/236; 4/248; 188/307
(58) Field of Search ..... 4/236, 246.1, 246.2, 4/248; 188/306, 307

(56) References Cited

U.S. PATENT DOCUMENTS 1,556,790 A * 10/1925 Helfinstine ..... 188/307
2,089,419 A * 8/1937 Peo et al. ..... 188/306
2,790,520 A * 4/1957 Kuhn, Jr. ..... 188/307
4,723,639 A * 2/1988 Hungerford ..... 188/307
5,697,122 A 12/1997 Okabe et al.
6,393,624 B1 5/2002 Iwashita

* cited by examiner

*Primary Examiner*—Robert M. Fetsuga
(74) *Attorney, Agent, or Firm*—Walter A. Hackler

(57) ABSTRACT

Damping apparatus for a toilet seat and toilet cover generally includes a hinged frame and a pair of mirror image dampers disposed in the frame for coupling with the toilet seat and toilet cover and providing independent damped closure thereof. Each damper includes a housing having a chamber with a rotor therein for supporting vanes disposed in slots and pivotable therein for enabling inward and outward movement of the vanes for controlling flow of fluid therepast in order to provide damping movement.

18 Claims, 6 Drawing Sheets

FIG. 6.
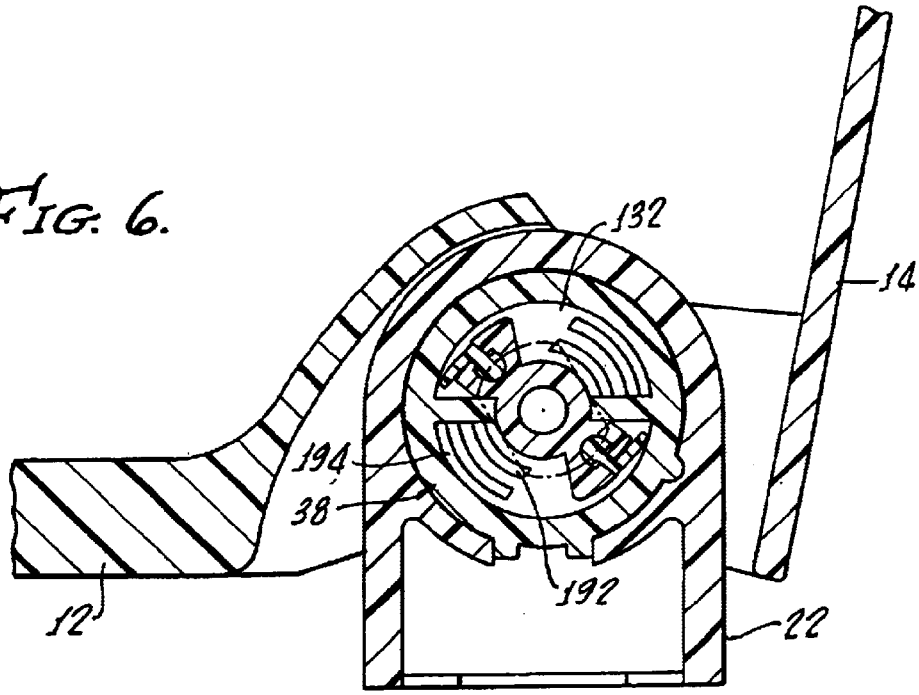
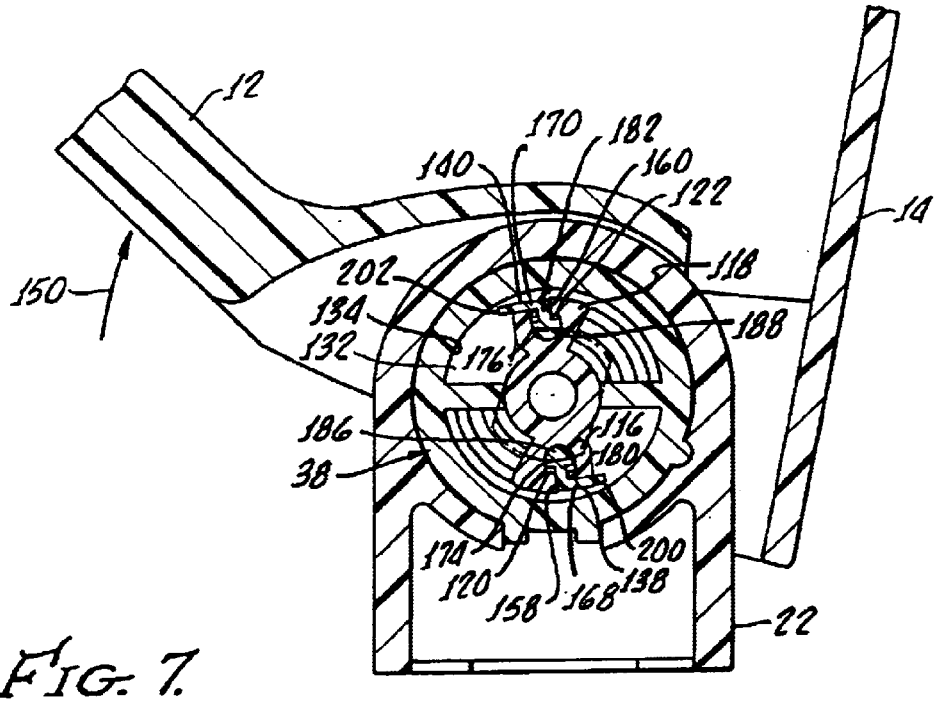
FIG. 7.

TOILET SEAT DAMPER

The present invention is generally related to hinge assemblies for toilet coverings and is more particularly directed to hinged damping apparatus for providing slow closing of toilet seats and toilet covers in order to prevent impact sounds otherwise common when a toilet seat or lid is dropped.

Toilet covering hinged assemblies have been designed in order to prevent accidental falling of a toilet seat with a generally unpleasant impact noise.

For example, in U.S. Pat. No. 6,393,624, a damping device for damping relative motion of a rotating member is provided which includes a damping mechanism with a viscous liquid disposed in a chamber along with a rotor also disposed in the chamber. The rotor includes a plurality of oil impingement parts, which are hingeably attached to the rotor. The structure of these damping hinge assemblies is complicated and includes a number of interconnected small parts, which not only makes assembly difficult but adds to manufacturing costs.

On the other hand, U.S. Pat. No. 5,697,122 discloses a rotary damper having a rotating member with at least one support projection for supporting a movable valve. However, because the valve 26 is disposed over the support projection failsafe operation over a long periods of time may not be possible due to the likelihood of dislodgement of the moveable valve from the support projection.

The present invention is directed to toilet seat and toilet cover damping apparatus, which includes a few parts, has easy assembly and provides for secure valving operation.

SUMMARY OF THE INVENTION

Damping apparatus for a toilet seat and toilet cover in accordance with the present invention preferably includes a hinged frame, which is adapted for being secured to a toilet, which hingeably supports the toilet seat and the toilet cover for independent movement over a toilet bowl.

A pair of mirror image dampers are disposed in the hinged frame for coupling with the toilet seat and the toilet cover and providing independent damped closure of the toilet seat and the toilet cover.

Each of the dampers preferably includes a housing having a chamber, a bore and a bearing disposed therein. The bearing has a smaller diameter than a chamber inside diameter and the bore and the housing includes an end wall disposed between the chamber inside diameter and the bearing.

A rotor is provided, which is includes a first portion rotatably disposed in the chamber and a second portion for supporting a key. The key is engaged with one of the toilet seat and toilet tank cover. Accordingly, each of the dampers is operable for independent damping of either the toilet seat or toilet cover.

A shank, formed in the first portion of the rotor, sealably engages a chamber and a journal, protruding from a shank, engages the bearing for rotation therein. The journal includes a smaller diameter than the chamber inside diameter.

A fluid is disposed in the chamber and an end seal, disposed in the bore, is provided for engaging the journal and sealing the fluid within the chamber. During assembly the fluid may be disposed within the chamber before the end seal is disposed in the bore and engages the journal. This facilitates assembly of the apparatus.

A pair of slotted arms are formed in the journal, which are disposed 180° from one another and each arm has an end face for sealably and slidably engaging the chamber end wall. A pair of vanes is provided with each vane being disposed in one of the arm slots and pivotable therein for enabling each vane to extend outward from a respective arm for engaging the chamber inside diameter upon rotation of the rotor in one direction to resist flow of the fluid therepast.

This provides a resisted movement in the one direction and provides damped movement of one of the toilet seat or the toilet seat cover.

The pivotable action of the vanes enables inward movement thereof from the chamber inside diameter to enable less resistive flow of the fluid therepast upon rotation of the rotor in an opposite direction and this provides undamped movement of one of the toilet seat and the toilet seat cover in the opposite direction.

More particularly, the end seal comprises a screw therethrough for threadably engaging the journal for preventing longitudinal movement of the rotor within the chamber. In addition, the end seal screw also biases, or forces, the slotted arm ends against the chamber end wall. Control of overall movement of the toilet seat and cover may be provided by adjustment of the second seal screw.

Each of the slotted arms include a longitudinal slot for receiving a respective vane. More particularly, each slot is open to a respective arm surface, which faces the chamber inside diameter and the slot openings are narrower than a slot cavity subtending each opening. Each vane includes a flap portion disposed at a generally right angle with a shank portion and the shank portion includes a neck for slidably engaging a respective slot opening and a body portion sized for pivoting within the slot cavity. The body portion includes a dimension for preventing passage through a respective slot opening.

Still more particularly, each of the end seals includes means for rotationally locking each end seal with a respective rotor and preferably such means includes a slot on each journal end and a key in each end seal for engaging a respective end slot.

BRIEF DESCRIPTION OF THE DRAWINGS

The advantages and features of the present invention will be better understood by the following description when considered in conjunction with the accompanying drawings in which:

FIG. 6 is a partial cross sectional view of the damping apparatus illustrating rotor positions with a toilet seat in a closed position with a toilet seat in a closed position and a toilet cover in an open position;

FIG. 7 is a view similar to that shown in FIG. 6 with the toilet seat being raised;

DETAILED DESCRIPTION

Figure 1:
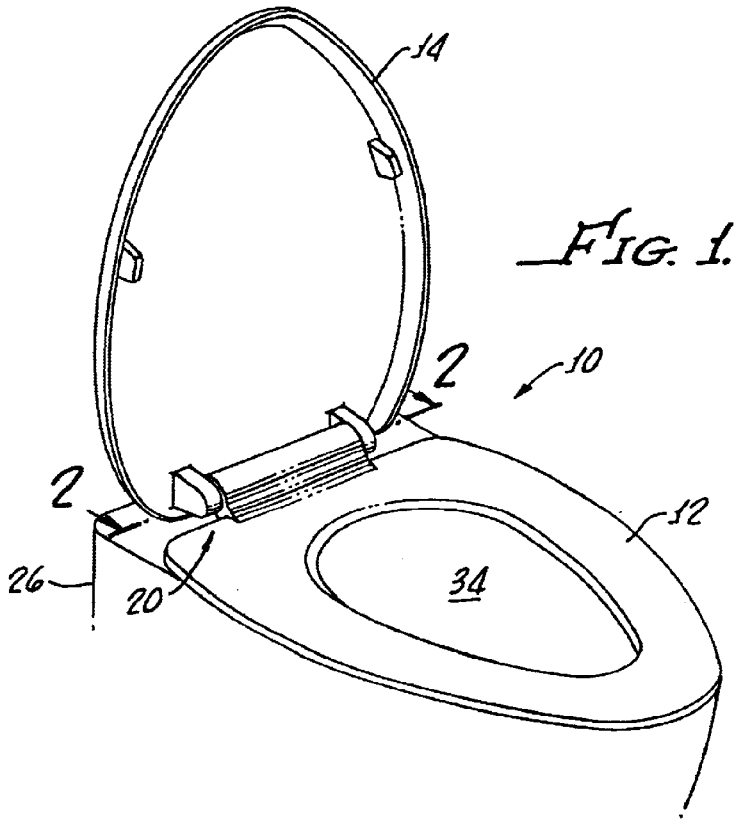
FIG. 1 is an assembly in accordance with the present invention generally showing a toilet seat cover and a toilet seat hingeably attached to a toilet bowl.
Figure 2:
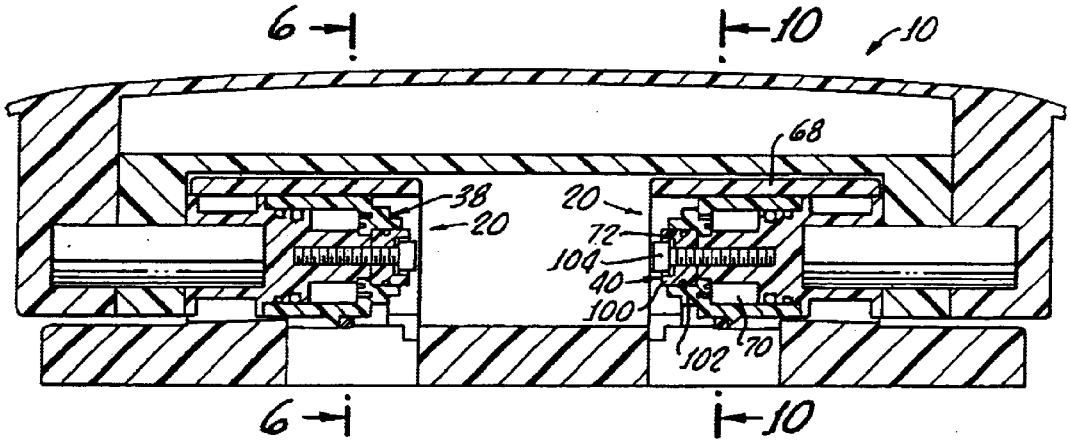
FIG. 2 is a cross sectional view taken along the line 2—2 of FIG. 1 showing the damping apparatus in accordance with the present invention.
Figure 3:
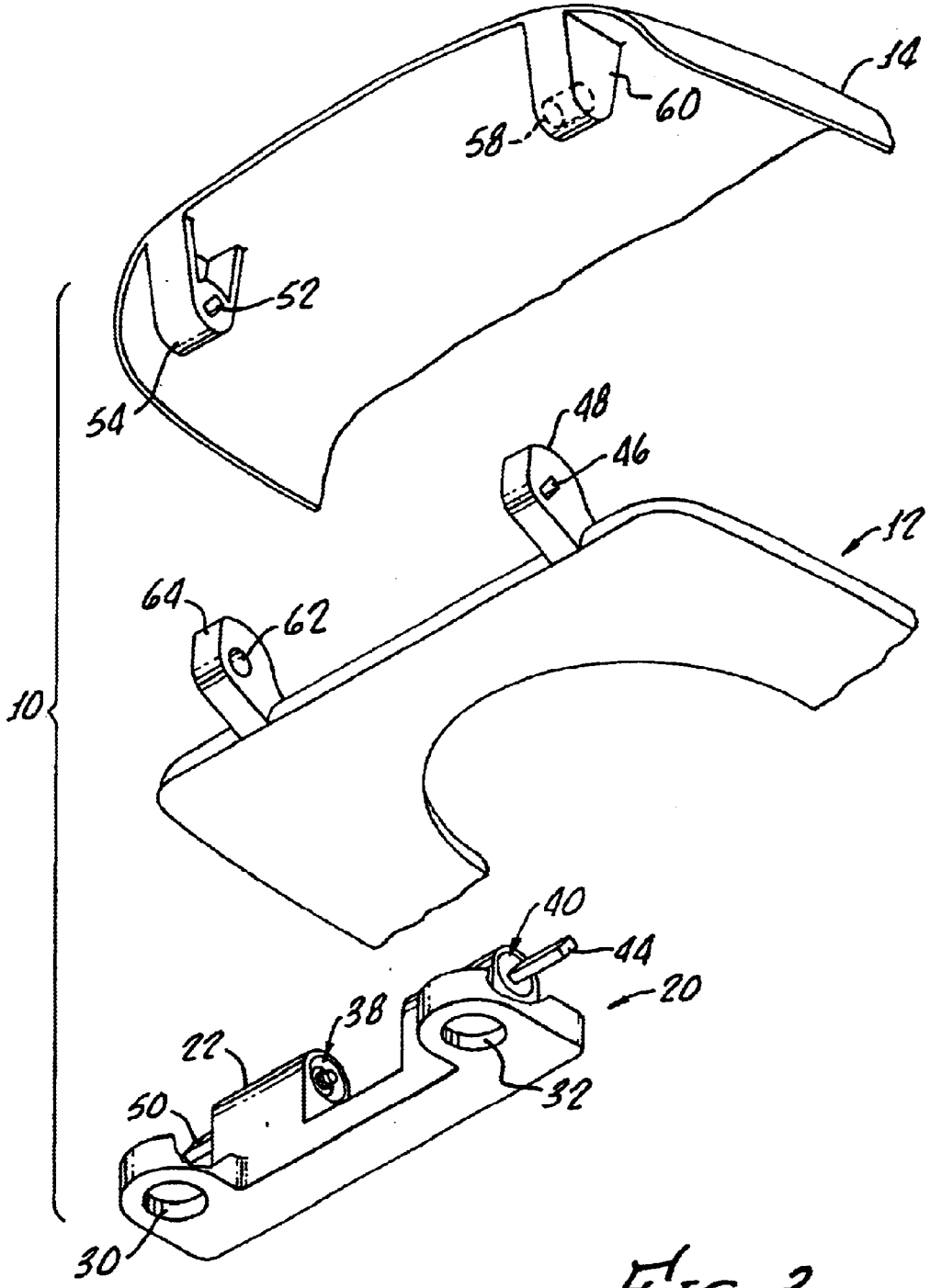
FIG. 3 is an exploded perspective view more clearly showing a hinged frame for hingeably supporting the toilet seat and toilet seat cover.

With reference to FIGS. 1–3, there is shown an apparatus 10 in accordance with the present invention, which generally may include a toilet seat 12, a toilet cover 14 and damping apparatus 20 and a hinged frame 22, which is adaptable for being secured to a toilet 26 by way of bolts, now shown, through mounting holes 30, 32 in a conventional manner.

The hinged frame 22 hingeably supports the toilet seat 12 and toilet cover 14 for independent movement over the toilet bowl 34. A pair of mirror image dampers 38, 40 are disposed in the hinged frame 22 as best shown in FIG. 2 for coupling with the toilet seat 12 and toilet cover 14 and providing independent damped closure of the toilet seat 12 and toilet cover 14.

A key 44 extending from the damper 40 engages a slot 46 in an extension 48 of the toilet seat 12 to provide damping movement thereof as hereinafter described. Similarly, a key 50 extending from the damper 38 engages a slot 52 and a toilet cover extension 54 for providing independent damped closure thereof as hereinafter described in greater detail.

Independent damped closure of the toilet seat 12 and toilet cover 14 is enabled by a bore 58 in a toilet cover extension 60, which enables rotation of the key 44 without engagement and a bore 62 in a toilet seat extension 64 which enables rotation of the key 50 therein without engagement with the toilet seat 12.

Figure 4:
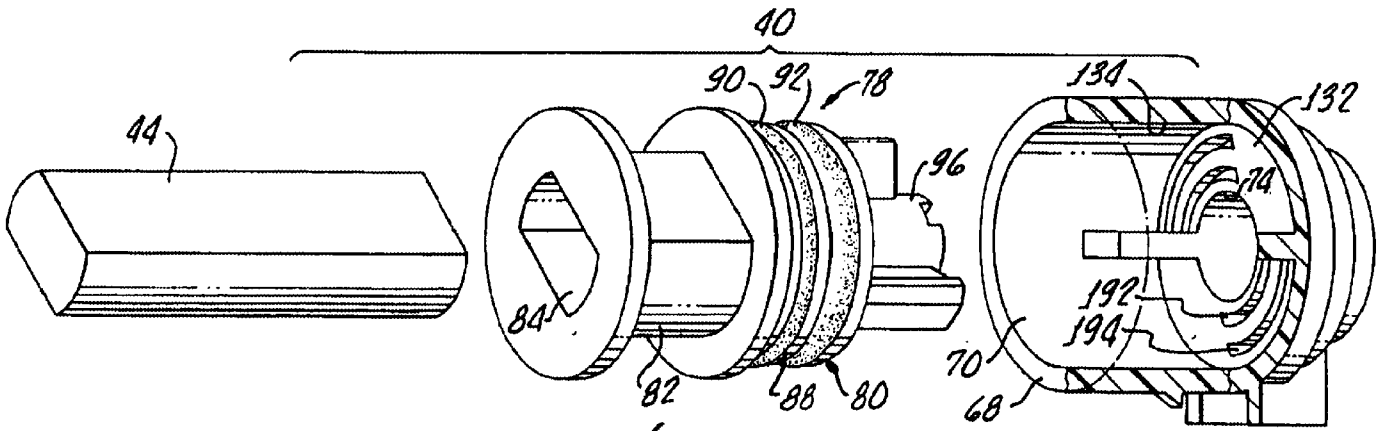
FIG. 4 is an exploded view of damping apparatus in accordance with the present invention generally showing a housing, a rotor, a key and an end seal.
Figure 5:
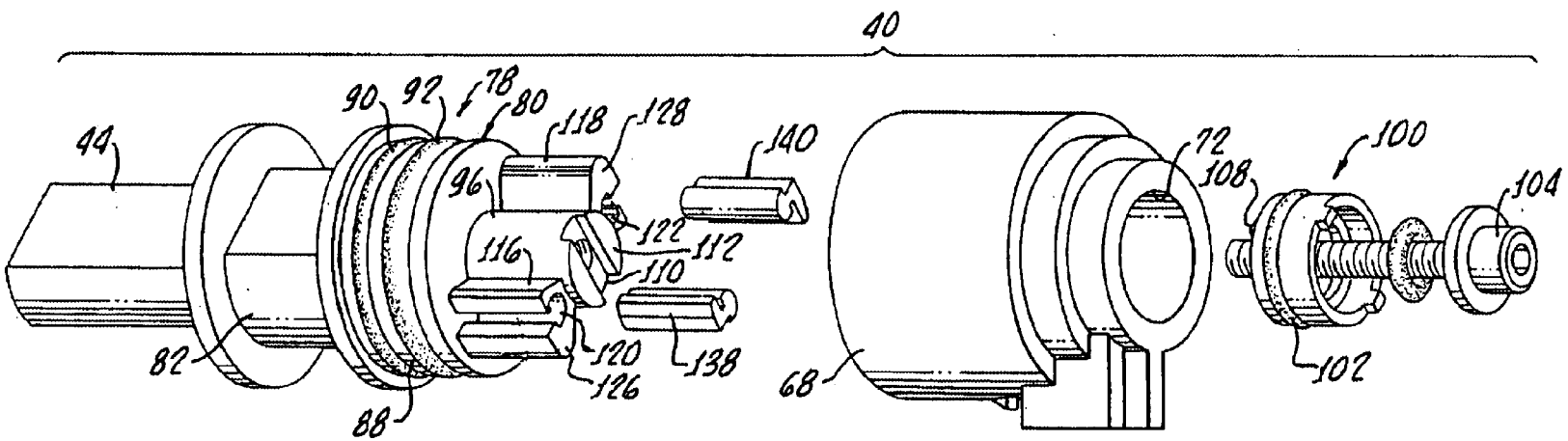
FIG. 5 is a exploded perspective view of the damping apparatus shown in FIG. 4 taken from a reverse angle.

With reference to FIGS. 4 and 5, there is shown exploded perspective views of the damper apparatus 40. In view of the fact that the dampers 38 and 40 are mirror images thereof, only one damper 40 will be described herein and such description is applicable for both dampers 38, 40.

The damper 40 includes a housing 68, including a chamber 70 with a bore 72 and a bearing 74 therebetween, see also FIG. 2.

A rotor 78 includes a first portion 80 rotatably disposed in the chamber 70 and a second portion including a slot 84 for supporting the key 44, the key 44 being engaged with the toilet seat slot 46 as hereinabove described. A shank 88 formed in the first portion 80 of the rotor 78 sealably engages the chamber 70 by way of o-rings 90, 92.

The rotor 78 and housing 68 may be formed from any suitable material, such as plastic or the like. A journal 96 protrudes from the shank 88 and engages the bearing 74 for rotation therein.

Upon insertion of the rotor first portion 80 into the chamber 70, the chamber 70 is filled with a fluid through the bore 72. Thereafter, an end seal 100 is disposed in the bore 72 for sealing the fluid in the chamber by way of an o-ring 102.

A screw 104 threadably engages the journal 96, thereby engaging the end seal 100 with the journal 96 and preventing longitudinal movement of the rotor 78 within the chamber 70. The end seal includes a key 108 for engaging a slot 110 in an end 112 of the journal 96, which provides a means for rotationally locking the end seal 100 with the rotor 78.

A pair of arms 116, 118 formed in the journal 96, and disposed 180° from one another, are provided with each arm including a slot 120, 122 and an end faces 126, 128 for sealably and slidably engaging a chamber end wall 132 extending between a chamber inside surface 134 and the bearing 74, see FIG. 4.

Also, as hereinabove noted the screw 104 biases the arm end faces 126, 128 against the chamber end wall 132 for providing a seal therebetween. Control of sealing and sealing pressure can be effected by the screw 104. This results in an external control of the damped movement of the toilet seat 12 and cover 14.

Figure 8:
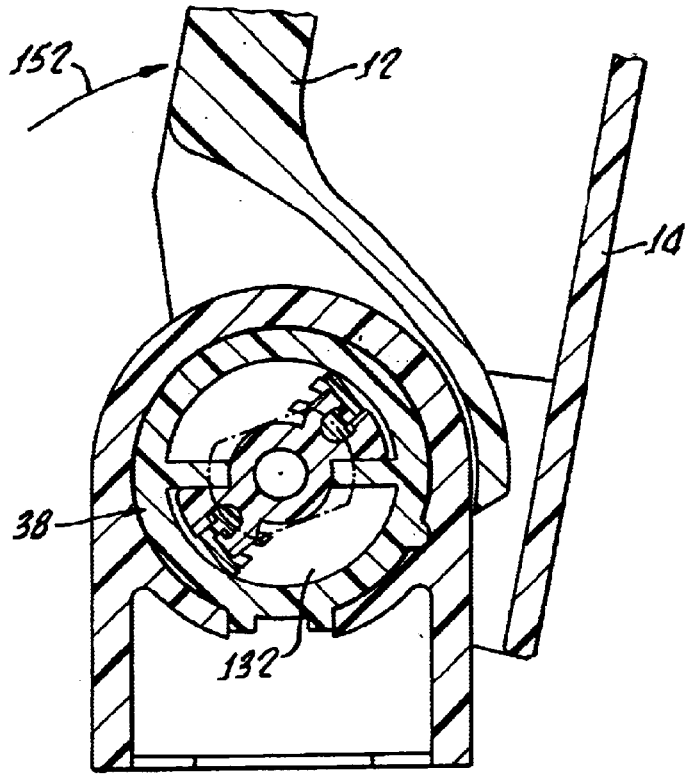
FIG. 8 is a view similar to FIGS. 6 and 7 showing the toilet seat in a raised position.
Figure 9:
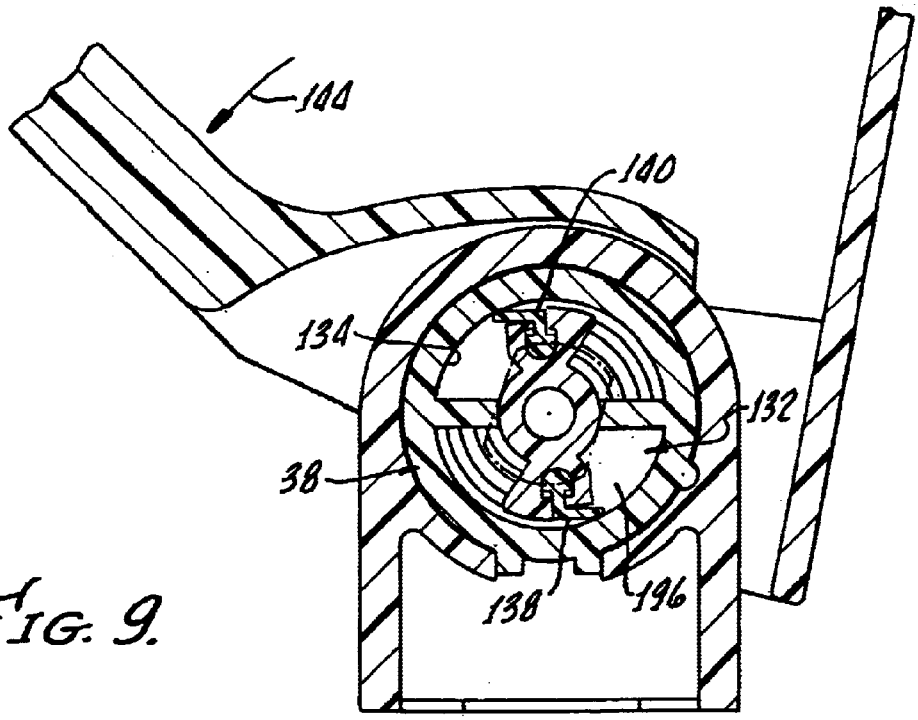
FIG. 9 is a view similar to FIGS. 6, 7 and 8 showing the toilet seat being moved in a closed direction with damping or resistance provided by the damping apparatus.
Figure 10:
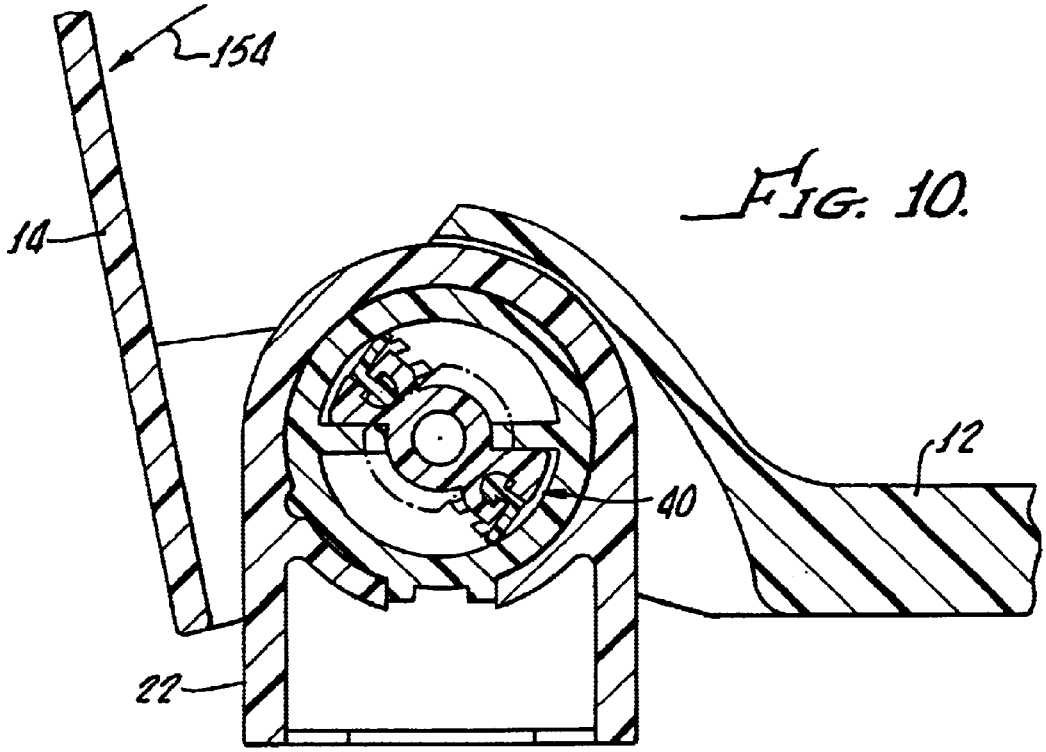
FIG. 10 is a cross sectional view of the lid damping apparatus showing the lid in an open position.
Figure 11:
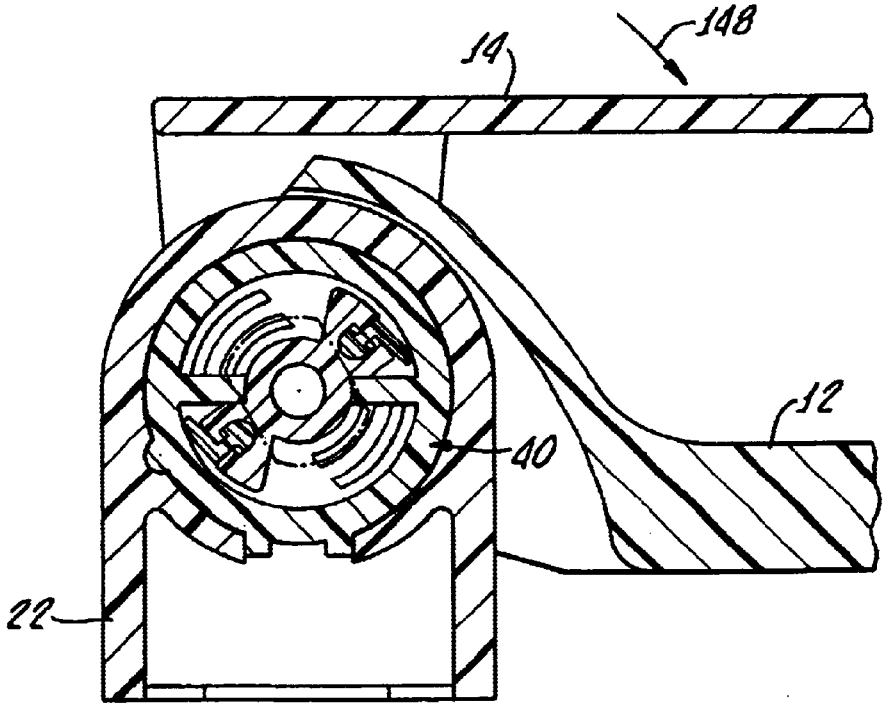
FIG. 11 is a view similar to that shown in FIG. 10 showing the lid and seat in a closed position.

Vanes 138, 140 are disposed in the slots 120, 122 and pivotable therein for engaging the chamber inside surface 134 (see also FIGS. 6–11) upon rotation of the rotor 78 in one direction as indicated by the arrow 144 in FIG. 9 to resist flow of the fluid therepast in order to resist movement in the one direction 144 and provide damped movement of the toilet seat 12 or toilet cover 14 in a closing direction as indicated by the arrow 148 in FIG. 11.

The vanes 138, 140 pivot inwardly upon movement of the toilet seat 12 or toilet seat cover 14 in an opposite direction as indicated by the arrows 150, 152, 154 in FIGS. 7, 8 and 10 respectively to enable less restrictive flow of fluid therepast upon rotation of the rotor 78 in the opposite direction indicated by the arrows 150, 152, 154 in order to provide undamped movement of the toilet seat 12 and toilet cover 14 upon opening.

This pivotable movement is enabled by the longitudinal slots 120, 122.

Each vane 138, 140 includes a flap portion 168, 170 disposed generally right angle with a shank portion 174, 176.

Each shank portion 174, 176 includes a neck 180, 182 for slidably engaging a respective slot opening 158, 160 and a body portion 186, 188 having a passage through respective slot opening 158, 160.

The dimensions of the shank 174, 176 are made for enabling both pivotal and radial movement of the vane 138, 140 in slots 120, 122 so that the vanes can move outwardly and inwardly as hereinabove described for causing damped movement of the toilet seat 12 and cover 14.

It should be appreciated that common reference characters are used for both dampers 38, 40 inasmuch as they are mirror images of one another.

As hereinabove noted, end faces 126, 128 of the arms 116, 118 sealably engage the chamber end wall 132. This engagement prevents fluid movement therepast and enhances the damping effect of the vanes 138, 140 as hereinabove described. This seal is controlled by the end seal screw 104.

Further control of fluid movement is provided by grooves 192, 194, see FIGS. 4 and 6–11. The grooves 192, 194 are positioned in the end wall 132 for enabling fluid to pass past the end faces 126, 128 as illustrated in FIGS. 6–8 upon opening of the toilet seat 12 in a direction indicated by the arrows 150, 152.

However, upon closing as indicated by the arrow 144 in FIG. 9, the end faces 126, 128 (not shown in FIG. 9) engage a non-grooved area 196 of the end wall 132, thus preventing fluid therepast and enhancing the damping action of the vanes 138, 140 shown in an outwardly extending position in FIG. 9 in which the flaps 168, 170 engages the inside surface 134 of the chamber 70.

As hereinabove described on opening of the toilet seat 12 in the direction of the arrow 150, the flaps 168, 170 are pushed inwardly by the fluid and provide gaps 200, 202 for passage of fluid therepast.

Although there has been hereinabove described a specific toilet seat damper in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element, which is not specifically disclose herein. Accordingly, any and all modifications, variations or equivalent arrangements, which may occur to those skilled in the art, should be considered to be within the scope of the present invention as defined in the appended claims.

What is claimed is:

1. Damping apparatus for a toilet seat and toilet cover, the apparatus comprising:

a hinge frame, adaptable for being secured to a toilet, for hingeably supporting said toilet seat and said toilet cover for independent movement over a toilet bowl; and a pair of mirror image dampers disposed in said hinge frame for coupling with said toilet seat and said toilet cover and providing independent damped closure of said toilet seat and said toilet cover, each damper comprising:

a housing having a chamber, a bore and a bearing disposed therebetween, said bearing having a smaller diameter than a chamber inside surface and said bore, said housing including an end wall disposed between the chamber inside surface and said bearing;

a rotor having a first portion rotatably disposed in said chamber and a second portion for supporting a key, said key being engaged with one of said toilet seat and said toilet cover;

a shank formed in said first portion for sealably engaging said chamber;

a journal protruding from said shank and engaging said bearing for rotation therein, said journal having a smaller diameter than a diameter of said chamber inside surface;

a fluid disposed in said chamber;

an end seal, disposed in said bore, for engaging said journal and sealing said fluid in said chamber;

a pair of slotted arms formed in said journal 180° from one another and each arm having an end face for sealably and slidably engaging the chamber end wall; and a pair of vanes, each vane being disposed in one of the arm slots and pivotable therein for enabling each vane to extend outwardly from a respective arm for engaging said chamber inside surface upon rotation of said rotor in one direction to resist flow of the fluid therepast in order to resist movement in said one direction and provide damped movement of one of said toilet seat and said toilet cover and moving inwardly from said chamber inside surface to enable less resistive flow of the fluid therepast upon rotation of said rotor in an opposite direction and provide undamped movement of one of said toilet seat and seat toilet cover in said opposite direction.

2. The apparatus according to claim 1 wherein said end seal comprises a screw therethrough for threadably engaging said journal for preventing longitudinal movement of said rotor in said chamber.

3. The apparatus according to claim 2 wherein each of said slotted arms include a longitudinal slot for receiving a respective vane.

4. The apparatus according to claim 3 wherein each slot is open to a respective arm surface facing the chamber inside surface.

5. The apparatus according to claim 4 wherein each slot opening is narrower than a slot cavity subtending each opening.

6. The apparatus according to claim 5 wherein each vane includes a flap portion disposed at a generally right angle with a shank portion.

7. The apparatus according to claim 6 wherein each shank portion includes a neck for slidably engaging a respective slot opening and a body portion sized for pivoting within said slot cavity, said body portion having a dimension preventing passage through said respective slot opening.

8. The apparatus according to claim 2 wherein said end seals each include means for rotationally locking each end seal with a respective rotor.

9. The apparatus according to claim 8 wherein said means for rotationally locking each end seal comprising a slot on end of each journal and a key in each end seal for engaging a respective end slot.

10. Toilet seat and toilet cover damping apparatus comprising:

a toilet seat;

a toilet cover;

a hinge frame, adaptable for being secured to a toilet, for hingeably supporting said toilet seat and said toilet cover for independent movement over a toilet bowl; and a pair of mirror image dampers disposed in said hinge frame for coupling with said toilet seat and said toilet cover and providing independent damped closure of said toilet seat and said toilet cover, each damper comprising:

a housing having a chamber, a bore and a bearing disposed therebetween, said bearing having a smaller diameter than a chamber inside surface and said bore, said housing including an end wall disposed between the chamber inside surface and said bearing;

a rotor having a first portion rotatably disposed in said chamber and a second portion for supporting a key, said key being engaged with one of said toilet seat and said toilet cover;

a shank formed in said first portion for sealably engaging said chamber;

a journal protruding from said shank and engaging said bearing for rotation therein, said journal having a smaller diameter than a diameter of said chamber inside surface;

a fluid disposed in said chamber;

a pair of slotted arms formed in said journal 180° from one another and each arm having an end face for sealably and slidably engaging the chamber end wall;

an end seal, disposed in said bore, for engaging said journal and sealing said fluid in said chamber and biasing the arm faces against the chamber and wall; and a pair of vanes, each vane being disposed in one of the arm slots and pivotable therein for enabling each vane to extend outwardly from a respective arm for engaging said chamber inside surface upon rotation of said rotor in one direction to resist flow of the fluid therepast in order to resist movement in said one direction and provide damped movement of one of said toilet seat and said toilet cover and moving inwardly from said chamber inside surface to enable less resistive flow of the fluid therepast upon rotation of said rotor in an opposite direction and provide undamped movement of one of said toilet seat and seat toilet cover in said opposite direction.

11. The apparatus according to claim 10 wherein said end seal comprises a screw therethrough for threadably engaging said journal for preventing longitudinal movement of said rotor in said chamber.

12. The apparatus according to claim 11 wherein each of said slotted arms include a longitudinal slot for receiving a respective vane.

13. The apparatus according to claim 12 wherein each slot is open to a respective arm surface facing the chamber inside surface.

14. The apparatus according to claim 13 wherein each slot opening is narrower than a slot cavity subtending each opening.

15. The apparatus according to claim 14 wherein each vane includes a flap portion disposed at a generally right angle with a shank portion.

16. The apparatus according to claim 15 wherein each shank portion includes a neck for slidably engaging a respective slot opening and a body portion sized for pivoting within said slot cavity, said body portion having a dimension preventing passage through said respective slot opening.

17. The apparatus according to claim 11 wherein said end seals each include means for rotationally locking each end seal with a respective rotor.

18. The apparatus according to claim 17 wherein said means for rotationally locking each end seal comprising a slot on end of each journal and a key in each end seal for engaging a respective end slot.

* * * * *